US011438979B2

(12) United States Patent
Zha et al.

(10) Patent No.: US 11,438,979 B2
(45) Date of Patent: Sep. 6, 2022

(54) LED DRIVING CIRCUIT AND LED DRIVING METHOD

(71) Applicant: Joulwatt Technology (Hangzhou)Co., LTD., Zhejiang (CN)

(72) Inventors: Zhenxu Zha, Zhejiang (CN); Pitelong Wong, Zhejiang (CN); Xunwei Zhou, Zhejiang (CN)

(73) Assignee: Joulwatt Technology (Hangzhou)Co., LTD., Hangzhou (CN)

( * ) Notice: Subject to any disclaimer, the term of this patent is extended or adjusted under 35 U.S.C. 154(b) by 0 days.

(21) Appl. No.: 17/092,353

(22) Filed: Nov. 9, 2020

(65) Prior Publication Data

US 2021/0144822 A1 May 13, 2021

(30) Foreign Application Priority Data

Nov. 11, 2019 (CN) ..... 201911095252.6

(51) Int. Cl.

| | |
|---|---|
| ***H05B 45/14*** | (2020.01) |
| ***H05B 45/30*** | (2020.01) |
| ***H05B 45/345*** | (2020.01) |
| ***H05B 45/3725*** | (2020.01) |

(52) U.S. Cl.

CPC ..... *H05B 45/14* (2020.01); *H05B 45/30* (2020.01); *H05B 45/345* (2020.01); *H05B 45/3725* (2020.01)

(58) Field of Classification Search

CPC .. H05B 45/14; H05B 45/345; H05B 45/3725; H05B 45/30–397

See application file for complete search history.

(56) References Cited

U.S. PATENT DOCUMENTS

| | | | | |
|---|---|---|---|---|
| 2012/0223649 | A1* | 9/2012 | Saes | H05B 45/3725 315/186 |
| 2014/0246988 | A1* | 9/2014 | Chen | H02M 3/33523 315/223 |
| 2014/0266456 | A1* | 9/2014 | Vice | H03G 3/3042 330/291 |
| 2015/0230300 | A1* | 8/2015 | Knoedgen | H05B 45/385 315/219 |
| 2016/0118906 | A1* | 4/2016 | Freeman | H02M 7/06 363/21.05 |
| 2017/0023966 | A1* | 1/2017 | Kim | G01K 7/01 |

(Continued)

*Primary Examiner* — Abdullah A Riyami
*Assistant Examiner* — Syed M Kaiser
(74) *Attorney, Agent, or Firm* — Yu Gang

(57) ABSTRACT

The present disclosure provides an LED driving circuit and an LED driving method, which may be applied to a switching power supply driving circuit and a linear driving circuit. The LED driving circuit includes an adjusting tube and a driving control circuit of the adjusting tube. The adjusting tube receives an input voltage, and the driving control circuit adjusts the adjusting tube to output an output current to be expected. A reference generating circuit samples an output voltage of the LED driving circuit to obtain an output voltage sampling signal and a reference current signal corresponding to the output voltage sampling signal. A current adjusting circuit samples the output current to obtain an output current sampling signal, receives the corresponding reference current signal, and controls a conduction state of the adjusting tube according to the output current sampling signal and the reference current signal.

20 Claims, 1 Drawing Sheet

(56) References Cited

U.S. PATENT DOCUMENTS

| | | | | |
|---|---|---|---|---|
| 2017/0099011 | A1* | 4/2017 | Freeman | H02M 7/06 |
| 2017/0288557 | A1* | 10/2017 | Fang | H02M 1/4258 |
| 2018/0337599 | A1* | 11/2018 | Chen | H02M 3/158 |

* cited by examiner

LED DRIVING CIRCUIT AND LED DRIVING METHOD

CROSS-REFERENCE TO RELATED APPLICATIONS

The present disclosure claims priority to Chinese Patent Application No. 201911095252.6, filed on Nov. 11, 2019, the entire contents of which are hereby incorporated by reference.

TECHNICAL FIELD

The present disclosure relates to the technical field of power electrons, and in particular to a Light Emitting Diode (LED) driving circuit and an LED driving method.

BACKGROUND

Intelligent lighting is more and more widely applied, users want lamps to have different brightness by combining different scenes, and the requirement of dimming begins to become the basic requirement of the users. However, during deep dimming, the lamp is started in a dark condition, and a problem of low starting speed exists, since a reference voltage is small when the current is small and the output capacitance is usually large when a power factor is high. Therefore, the load can be lighted by charging the output capacitance to a forward voltage drop of LED lamp beads during starting, the starting speed is too slow. As the steady-state current is small, the starting speed is low.

SUMMARY

In at least some embodiments of the present disclosure, an LED driving circuit and an LED driving method that enable quick starting in deep dimming applications are provided to at least partially solve the technical problem of difficulty in achieving quick starting in the related art.

In one embodiment of the present disclosure, an LED driving circuit having the following structure is provided, which includes an adjusting tube and a driving control circuit of the adjusting tube. The adjusting tube receives an input voltage, and the driving control circuit adjusts the adjusting tube according to the input voltage to output an output current to be expected. The driving control circuit includes:

a reference generating circuit, configured to sample an output voltage of the LED driving circuit to obtain an output voltage sampling signal and a reference current signal corresponding to the output voltage sampling signal; and a current adjusting circuit, connected with a control end of the adjusting tube, and configured to sample the output current to obtain an output current sampling signal, receive the reference current signal, and control a conduction state of the adjusting tube according to the output current sampling signal and the reference current signal so as to adjust a current flowing through the adjusting tube.

In an optional embodiment, the reference current signal is a continuous analog signal, and when the reference current signal is the continuous analog signal, the smaller the output voltage, the larger the reference current signal.

In an optional embodiment, when the reference current signal is a discrete analog value, the reference current signal includes a first reference current signal and a second reference current signal, the second reference current signal being larger than the first reference current signal; when the output voltage sampling signal is smaller than a first reference voltage signal, the second reference current signal is selected to be connected with the current adjusting circuit; and when the output voltage sampling signal is larger than the first reference voltage signal, the first reference current signal is selected to be connected with the current adjusting circuit.

In an optional embodiment, the reference generating circuit includes an output voltage sampling circuit and a comparing circuit, the output voltage sampling circuit is configured to sample the output voltage to obtain the output voltage sampling signal and the comparing circuit is configured to receive the output voltage sampling signal and the first reference voltage signal, and compare the output voltage sampling signal with the first reference voltage signal to output a comparison result.

In an optional embodiment, the current adjusting circuit is an operational amplifier, two input ends of the operational amplifier respectively receive the reference current signal and the output current sampling signal, and an output end of the operational amplifier is connected with the control end of the adjusting tube.

In an optional embodiment, the LED driving circuit further includes an adjusting tube voltage detection circuit, configured to sample a voltage across the adjusting tube to obtain an adjusting tube voltage sampling signal, and compare the adjusting tube voltage sampling signal with a set threshold voltage, so that when the adjusting tube voltage sampling signal is larger than the set threshold voltage, the current adjusting circuit forces and maintains access to the first reference current signal.

In an optional embodiment, the reference current signal is a discrete analog value, and when the reference current signal is the discrete analog value, a value of the reference current signal is selected according to the magnitude of the output voltage.

In an optional embodiment, between an upper limit of the output voltage and a lower limit of the output voltage, the smaller the output voltage, the larger the reference current signal, and a fixed reference current signal is employed outside the upper limit of the output voltage and the lower limit of the output voltage.

In an optional embodiment, the reference generating circuit is further configured to select the reference current signal corresponding to the comparison result.

In an optional embodiment, the LED driving circuit further includes an adjusting tube voltage detection circuit, configured to sample a voltage across the adjusting tube to obtain an adjusting tube voltage sampling signal, and compare the adjusting tube voltage sampling signal with a set threshold voltage, so that when the adjusting tube voltage sampling signal is larger than the set threshold voltage, the current adjusting circuit forcibly turns off the adjusting tube.

In an optional embodiment, the LED driving circuit further includes an adjusting tube voltage detection circuit, configured to sample a voltage across the adjusting tube to obtain an adjusting tube voltage sampling signal, and compare the adjusting tube voltage sampling signal with a set threshold voltage, so that when the adjusting tube voltage sampling signal is larger than the set threshold voltage, the current adjusting circuit forcibly turns off the adjusting tube.

In an optional embodiment, the current adjusting circuit is an operational amplifier, two input ends of the operational amplifier respectively receive the reference current signal and the output current sampling signal, and an output end of the operational amplifier is connected with the control end of the adjusting tube.

In an optional embodiment, the LED driving circuit further includes an adjusting tube voltage detection circuit, configured to sample a voltage across the adjusting tube to obtain an adjusting tube voltage sampling signal, and compare the adjusting tube voltage sampling signal with a set threshold voltage, so that when the adjusting tube voltage sampling signal is larger than the set threshold voltage, the current adjusting circuit forces and maintains access to the first reference current signal.

In one embodiment of the present disclosure, an LED driving circuit including a switching power supply and a driving control circuit of the switching power supply is also provided. The switching power supply receives an input voltage, and the driving control circuit adjusts the switching power supply according to the input voltage to output an output current to be expected. The driving control circuit includes:

a reference generating circuit, configured to sample an output voltage of the switching power supply to obtain an output voltage sampling signal, compare the output voltage sampling signal with a first reference voltage signal to output a comparison result, and select a reference current signal according to the comparison result; and a current adjusting circuit, connected with a control end of a switching tube of the switching power supply, and configured to sample the output current to obtain an output current sampling signal, receive the reference current signal, and control a conduction state of the switching tube of the switching power supply according to the output current sampling signal and the reference current signal so as to adjust an output current of the switching power supply.

In one embodiment of the present disclosure, an LED driving method applied to an LED driving circuit is also provided. The LED driving circuit includes an adjusting tube and a driving control circuit of the adjusting tube, the adjusting tube receives an input voltage, and the driving control circuit adjusts the adjusting tube according to the input voltage to output an output current to be expected. The LED driving method includes the following steps:

an output voltage of the LED driving circuit is sampled to obtain an output voltage sampling signal and a reference current signal corresponding to the output voltage sampling signal; and the output current is sampled to obtain an output current sampling signal, and a conduction state of the adjusting tube is controlled according to the output current sampling signal and the reference current signal so as to adjust a current flowing through the adjusting tube.

In an optional embodiment, the reference current signal is a continuous analog signal, and when the reference current signal is the continuous analog signal, the smaller the output voltage, the larger the reference current signal.

In an optional embodiment, the reference current signal is a discrete analog value, and when the reference current signal is the discrete analog value, a value of the reference current signal is selected according to the magnitude of the output voltage.

In an optional embodiment, between an upper limit of the output voltage and a lower limit of the output voltage, the smaller the output voltage, the larger the reference current signal, and a fixed reference current signal is employed outside the upper limit of the output voltage and the lower limit of the output voltage.

In an optional embodiment, when the reference current signal is a discrete analog value, the reference current signal includes a first reference current signal and a second reference current signal, the second reference current signal being larger than the first reference current signal; when the output voltage sampling signal is smaller than a first reference voltage signal, the second reference current signal is selected to be connected with the current adjusting circuit; and when the output voltage sampling signal is larger than the first reference voltage signal, the first reference current signal is selected to be connected with the current adjusting circuit.

In an optional implementation, the method further includes:

the output voltage is sampled to obtain the output voltage sampling signal;

the output voltage sampling signal and the first reference voltage signal are received, and the output voltage sampling signal is compared with the first reference voltage signal to output a comparison result; and the reference current signal corresponding to the comparison result is selected.

Compared with the related art, at least some embodiments of the present disclosure have the following advantages: different reference current signals can be selected under different output voltages through the reference generating circuit, the first reference current signal and the second reference current signal are set, and rapid starting can be realized through a large current reference under the conditions of low brightness in deep dimming. Whether quick starting is enabled or not is controlled through the adjusting tube voltage detection circuit, so that the stress of the adjusting tube is moderate.

DETAILED DESCRIPTION

Hereinafter, exemplary embodiments of the present disclosure will be described in detail with reference to the accompanying drawings, but the present disclosure is not limited to these embodiments. The present disclosure covers any alternatives, modifications, equivalents, and alternatives falling within the spirit and scope of the present disclosure.

In the following detailed description of the exemplary embodiments of the present disclosure, specific details are set forth in order to provide a thorough understanding of the present disclosure, and the present disclosure may be fully understood by those skilled in the art without the description of such details.

The present disclosure is more particularly described by way of example in the following paragraphs with reference to the accompanying drawings. It is to be understood that the drawings are simplified in form and are not necessarily to scale, for purposes of illustrating the embodiments of the present disclosure in a convenient and clear manner.

Figure 1:
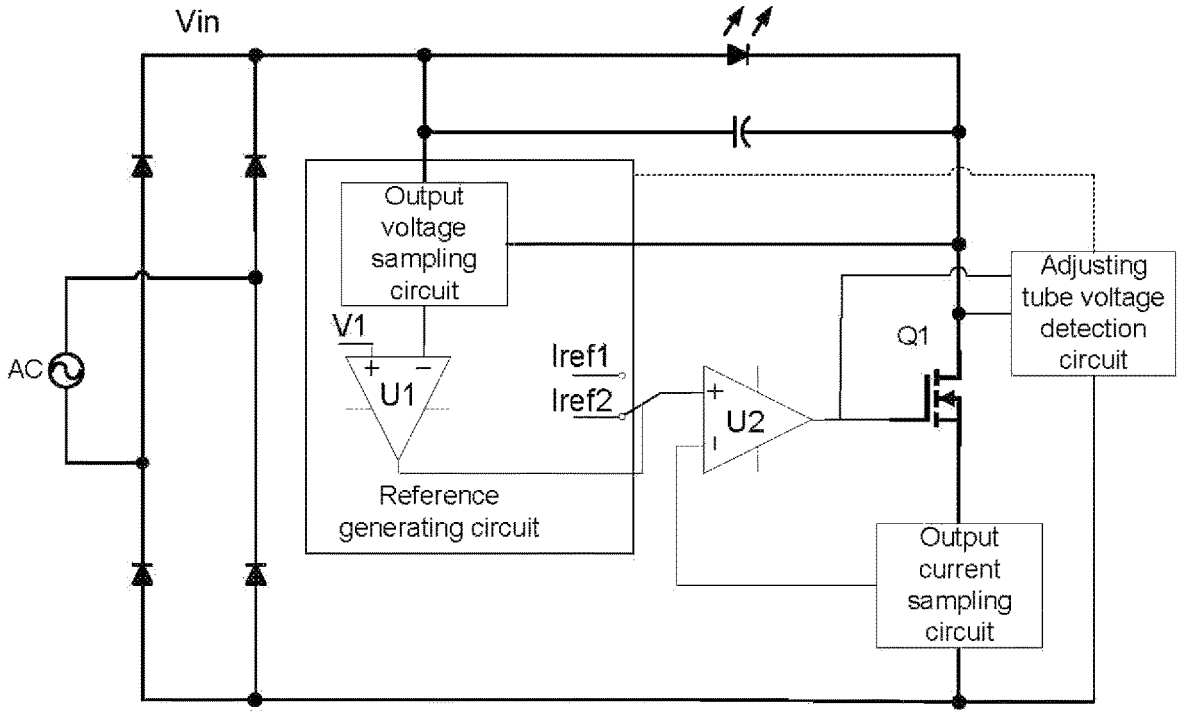
FIG. 1 is a circuit structural diagram of an LED driving circuit according to a first exemplary embodiment of the present disclosure.

As shown in FIG. 1, a circuit structure of an LED driving circuit according to a first exemplary embodiment of the present disclosure is illustrated.

The LED driving circuit is a linear driving circuit, including an adjusting tube Q1 and a driving control circuit of the adjusting tube Q1. The adjusting tube Q1 receives an input voltage Vin, and the driving control circuit adjusts the adjusting tube Q1 according to the input voltage Vin to output an output current to be expected. The driving control circuit includes a reference generating circuit and a current adjusting circuit.

The reference generating circuit is configured to sample an output voltage of the LED driving circuit to obtain an output voltage sampling signal and a reference current signal corresponding to the output voltage sampling signal. The reference current signal is a continuous analog signal or a discrete analog value, and when the reference current signal is the continuous analog signal, the smaller the output voltage, the larger the reference current signal. Through setting the upper limit of the output voltage and the lower limit of the output voltage, the condition is met between the upper limit of the output voltage and the lower limit of the output voltage, and a fixed reference current signal can be adopted outside the upper limit of the output voltage and the lower limit of the output voltage. When the reference current signal is a discrete analog value, a value of the reference current signal is selected according to the magnitude of the output voltage. The embodiment of the present disclosure takes the reference current signal as a discrete analog value as an example to explain in detail.

A current adjusting circuit is connected with a control end of the adjusting tube Q1, samples the output current to obtain an output current sampling signal, receives the reference current signal, and controls a conduction state of the adjusting tube according to the output current sampling, signal and the reference current signal so as to adjust a current flowing through the adjusting tube Q1.

The reference current signal includes a first reference current signal Iref1 and a second reference current signal Iref2, and the second reference current signal Iref2 is larger than the first reference current signal Iref1. When the output voltage sampling signal is smaller than the first reference voltage signal V1, the second reference current signal Iref2 is selected to be connected with the current adjusting circuit; and when the output voltage sampling signal is larger than the first reference voltage signal V1, the first reference current signal Iref1 is selected to be connected with the current adjusting circuit.

The output voltage is sampled to obtain the output voltage sampling signal, the output voltage sampling signal is compared with the first reference voltage signal V1 to output a comparison result, and the reference current signal corresponding to the comparison result is selected. The reference generating circuit includes an output voltage sampling circuit and a comparing circuit. The output voltage sampling circuit is configured to sample the output voltage to obtain the output voltage sampling signal and the comparing circuit U1 is configured to receive the output voltage sampling signal and the first reference voltage signal, and compare the output voltage sampling signal with the first reference voltage signal to output the comparison result.

The current adjusting circuit is an operational amplifier U2, two input ends of the operational amplifier U2 respectively receive the reference current signal and the output current sampling signal, and an output end of the operational amplifier is connected with the control end of the adjusting tube Q1.

The LED driving circuit further includes an adjusting tube voltage detection circuit, configured to sample a voltage across the adjusting tube Q1 to obtain an adjusting tube voltage sampling signal, and compare the adjusting tube voltage sampling signal with a set threshold voltage, so that when the adjusting tube voltage sampling signal is larger than the set threshold voltage, the current adjusting circuit forces and maintains access to the first reference current signal Iref1 or forcibly turns off the adjusting tube. The adjusting tube voltage detection circuit may be connected with the control end of the adjusting tube Q1 for turning off the adjusting tube Q1, or the adjusting tube voltage detection circuit may be connected with a reference generating circuit (shown in dotted lines) for maintaining the forced access of the first reference current signal Iref1.

The present disclosure also provides an LED driving method, applied to an LED driving circuit. The LED driving circuit includes an adjusting tube and a driving control circuit of the adjusting tube. The adjusting tube Q1 receives an input voltage, and the driving control circuit adjusts the adjusting tube Q1 according to the input voltage to output an output current to be expected. The LED driving method includes the following steps.

An output voltage of the LED driving circuit is sampled to obtain an output voltage sampling signal, the output voltage sampling signal is compared with a first reference voltage signal to output a comparison result, and a reference current signal is selected according to the comparison result.

The output current is sampled to obtain an output current sampling signal, and a conduction state of the adjusting tube is controlled according to the output current sampling signal and the reference current signal so as to adjust a current flowing through the adjusting tube.

The reference current signal includes a first reference current signal Iref1 and a second reference current signal Iref2, and the second reference current signal Iref2 is larger than the first reference current signal Iref1. When the output voltage sampling signal is smaller than the first reference voltage signal V1, the second reference current signal Iref2 is selected as the reference current signal; and when the output voltage sampling signal is larger than the first reference voltage signal V1, the first reference current signal Iref1 is selected as the reference current signal.

Figure 2:
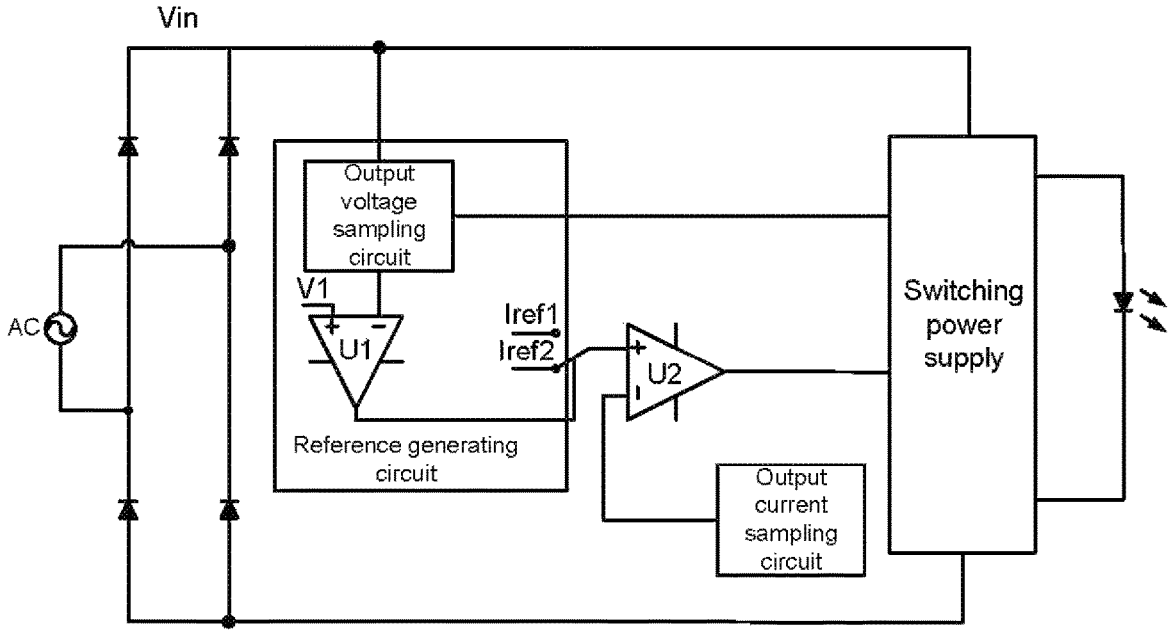
FIG. 2 is a circuit structural diagram of an LED driving circuit according to a second exemplary embodiment of the present disclosure.

As shown in FIG. 2, a circuit structure of an LED driving circuit according to a second exemplary embodiment of the present disclosure is illustrated. The LED driving circuit includes a switching power supply and a driving control circuit of the switching power supply. The switching power supply receives an input voltage Vin, and the driving control circuit adjusts the switching power supply according to the input voltage to output an output current to be expected. The driving control circuit includes a reference generating circuit and a current adjusting circuit.

The reference generating circuit is configured to sample an output voltage of the switching power supply to obtain an output voltage sampling signal and obtain a corresponding reference current signal according to the output voltage sampling signal. The reference current signal is a continuous analog signal or a discrete analog value, and when the reference current signal is the continuous analog signal, the smaller the output voltage, the larger the reference current signal. When the reference current signal is the discrete analog value, a value of the reference current signal is selected according to the magnitude of the output voltage. The embodiment of the present disclosure takes the reference current signal as a discrete analog value as an example to explain in detail. An output voltage is sampled to obtain an output voltage sampling signal, the output voltage sampling signal is compared with a first reference voltage signal V1 to output a comparison result, and a reference current signal is selected according to the comparison result.

The current adjusting circuit is connected with a control end of a switching tube of the switching power supply, and configured to sample the output current to obtain an output current sampling signal, receive the reference current signal, and control a conduction state of the switching tube of the switching power supply according to the output current sampling signal and the reference current signal so as to adjust an output current of the switching power supply.

The present disclosure also provides an LED driving method, applied to an LED driving circuit. The LED driving circuit includes a switching power supply and a driving control circuit of the switching power supply. The switching power supply receives an input voltage, and the driving control circuit adjusts the switching power supply according to the input voltage to output an output current to be expected. The method includes the following steps.

An output voltage is sampled, and the output voltage of the switching power supply is sampled to obtain an output voltage sampling signal and obtain a corresponding reference current signal according to the output voltage sampling signal. The reference current signal is a continuous analog signal or a discrete analog value, and when the reference current signal is the continuous analog signal, the smaller the output voltage, the larger the reference current signal. When the reference current signal is the discrete analog value, a value of the reference current signal is selected according to the magnitude of the output voltage.

The output current is sampled to obtain an output current sampling signal, the corresponding reference current signal is received, and a conduction state of the switching tube of the switching power supply is controlled according to the output current sampling signal and the reference current signal so as to adjust an output current of the switching power supply.

The above implementation manners do not limit the scope of protection of the technical solution. Any modifications, equivalents, and improvements within the spirit and principles of the above implementation manners are intended to be included within the scope of the technical solution.

What is claimed is:

1. An LED driving circuit, comprising an adjusting tube and a driving control circuit of the adjusting tube, the adjusting tube receiving an input voltage, and the driving control circuit adjusting the adjusting tube according to the input voltage to output an output current to be expected, wherein the driving control circuit comprises:

a reference generating circuit, configured to sample an output voltage of the LED driving circuit to obtain an output voltage sampling signal and a reference current signal corresponding to the output voltage sampling signal; and a current adjusting circuit, connected with a control end of the adjusting tube, and configured to sample the output current to obtain an output current sampling signal, receive the reference current signal, and control a conduction state of the adjusting tube according to the output current sampling signal and the reference current signal so as to adjust a current flowing through the adjusting tube.

2. The LED driving circuit as claimed in claim 1, wherein the reference current signal is a continuous analog signal, and when the reference current signal is the continuous analog signal, the smaller the output voltage, the larger the reference current signal.

3. The LED driving circuit as claimed in claim 1, wherein when the reference current signal is a discrete analog value, the reference current signal comprises a first reference current signal and a second reference current signal, the second reference current signal being larger than the first reference current signal; when the output voltage sampling signal is smaller than a first reference voltage signal, the second reference current signal is selected to be connected with the current adjusting circuit; and when the output voltage sampling signal is larger than the first reference voltage signal, the first reference current signal is selected to be connected with the current adjusting circuit.

4. The LED driving circuit as claimed in claim 3, wherein the reference generating circuit comprises an output voltage sampling circuit and a comparing circuit, the output voltage sampling circuit is configured to sample the output voltage to obtain the output voltage sampling signal and the comparing circuit is configured to receive the output voltage sampling signal and the first reference voltage signal, and compare the output voltage sampling signal with the first reference voltage signal to output a comparison result.

5. The LED driving circuit as claimed in claim 3, wherein the current adjusting circuit is an operational amplifier, two input ends of the operational amplifier respectively receive the reference current signal and the output current sampling signal, and an output end of the operational amplifier is connected with the control end of the adjusting tube.

6. The LED driving circuit as claimed in claim 1, wherein the LED driving circuit further comprises: an adjusting tube voltage detection circuit, configured to sample a voltage across the adjusting tube to obtain an adjusting tube voltage sampling signal, and compare the adjusting tube voltage sampling signal with a set threshold voltage, so that when the adjusting tube voltage sampling signal is larger than the set threshold voltage, the current adjusting circuit forces and maintains access to the first reference current signal.

7. The LED driving circuit as claimed in claim 1, wherein the reference current signal is a discrete analog value, and when the reference current signal is the discrete analog value, a value of the reference current signal is selected according to the magnitude of the output voltage.

8. The LED driving circuit as claimed in claim 2, wherein between an upper limit of the output voltage and a lower limit of the output voltage, the smaller the output voltage, the larger the reference current signal, and a fixed reference current signal is employed outside the upper limit of the output voltage and the lower limit of the output voltage.

9. The LED driving circuit as claimed in claim 4, wherein the reference generating circuit is further configured to select the reference current signal corresponding to the comparison result.

10. The LED driving circuit as claimed in claim 1, wherein the LED driving circuit further comprises: an adjusting tube voltage detection circuit, configured to sample a voltage across the adjusting tube to obtain an adjusting tube voltage sampling signal, and compare the adjusting tube voltage sampling signal with a set threshold voltage, so that when the adjusting tube voltage sampling signal is larger than the set threshold voltage, the current adjusting circuit forcibly turns off the adjusting tube.

11. The LED driving circuit as claimed in claim 2, wherein the LED driving circuit further comprises: an adjusting tube voltage detection circuit, configured to sample a voltage across the adjusting tube to obtain an adjusting tube voltage sampling signal, and compare the adjusting tube voltage sampling signal with a set threshold voltage, so that when the adjusting tube voltage sampling signal is larger than the set threshold voltage, the current adjusting circuit forcibly turns off the adjusting tube.

12. The LED driving circuit as claimed in claim 4, wherein the current adjusting circuit is an operational amplifier, two input ends of the operational amplifier respectively receive the reference current signal and the output current sampling signal, and an output end of the operational amplifier is connected with the control end of the adjusting tube.

13. The LED driving circuit as claimed in claim 2, wherein the LED driving circuit further comprises: an adjusting tube voltage detection circuit, configured to sample a voltage across the adjusting tube to obtain an adjusting tube voltage sampling signal, and compare the adjusting tube voltage sampling signal with a set threshold voltage, so that when the adjusting tube voltage sampling signal is larger than the set threshold voltage, the current adjusting circuit forces and maintains access to the first reference current signal.

14. An LED driving circuit, comprising a switching power supply and a driving control circuit of the switching power supply, the switching power supply receiving an input voltage, and the driving control circuit adjusting the switching power supply according to the input voltage to output an output current to be expected, wherein the driving control circuit comprises:

a reference generating circuit, configured to sample an output voltage of the switching power supply to obtain an output voltage sampling signal, compare the output voltage sampling signal with a first reference voltage signal to output a comparison result, and select a reference current signal according to the comparison result; and a current adjusting circuit, connected with a control end of a switching tube of the switching power supply, and configured to sample the output current to obtain an output current sampling signal, receive the reference current signal, and control a conduction state of the switching tube of the switching power supply according to the output current sampling signal and the reference current signal so as to adjust an output current of the switching power supply.

15. An LED driving method, applied to an LED driving circuit, the LED driving circuit comprising an adjusting tube and a driving control circuit of the adjusting tube, the adjusting tube receiving an input voltage, and the driving control circuit adjusting the adjusting tube according to the input voltage to output an output current to be expected, wherein the LED driving method comprises:

sampling an output voltage of the LED driving circuit to obtain an output voltage sampling signal and a reference current signal corresponding to the output voltage sampling signal; and sampling the output current to obtain an output current sampling signal, and controlling a conduction state of the adjusting tube according to the output current sampling signal and the reference current signal so as to adjust a current flowing through the adjusting tube.

16. The LED driving method as claimed in claim 15, wherein the reference current signal is a continuous analog signal, and when the reference current signal is the continuous analog signal, the smaller the output voltage, the larger the reference current signal.

17. The LED driving method as claimed in claim 15, wherein the reference current signal is a discrete analog value, and when the reference current signal is the discrete analog value, a value of the reference current signal is selected according to the magnitude of the output voltage.

18. The LED driving method as claimed in claim 16, wherein between an upper limit of the output voltage and a lower limit of the output voltage, the smaller the output voltage, the larger the reference current signal, and a fixed reference current signal is employed outside the upper limit of the output voltage and the lower limit of the output voltage.

19. The LED driving method as claimed in claim 15, wherein when the reference current signal is a discrete analog value, the reference current signal comprises a first reference current signal and a second reference current signal, the second reference current signal being larger than the first reference current signal; when the output voltage sampling signal is smaller than a first reference voltage signal, the second reference current signal is selected to be connected with the current adjusting circuit; and when the output voltage sampling signal is larger than the first reference voltage signal, the first reference current signal is selected to be connected with the current adjusting circuit.

20. The LED driving method as claimed in claim 15, further comprising:

sampling the output voltage to obtain the output voltage sampling signal;

receiving the output voltage sampling signal and the first reference voltage signal, and comparing the output voltage sampling signal with the first reference voltage signal to output a comparison result; and selecting the reference current signal corresponding to the comparison result.

* * * * *